US007222956B2

(12) United States Patent
Yokouchi et al.

(10) Patent No.: US 7,222,956 B2
(45) Date of Patent: May 29, 2007

(54) IMAGE DISPLAY APPARATUS

(75) Inventors: Tsutomu Yokouchi, Kanagawa (JP); Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 292 days.

(21) Appl. No.: 10/776,506

(22) Filed: Feb. 12, 2004

(65) Prior Publication Data

US 2004/0160501 A1 Aug. 19, 2004

(30) Foreign Application Priority Data

Feb. 14, 2003 (JP) ..... 2003-036300

(51) Int. Cl.
*B41J 2/01* (2006.01)

(52) U.S. Cl. ..... 347/107; 347/101

(58) Field of Classification Search ..... 347/107, 347/101, 112, 105; 358/1; 345/1; 359/296
See application file for complete search history.

(56) References Cited

U.S. PATENT DOCUMENTS 5,539,440 A * 7/1996 Higuchi et al. ..... 347/112
2003/0099027 A1* 5/2003 Shigehiro et al. ..... 359/296

FOREIGN PATENT DOCUMENTS

JP 2001-109406 4/2001
JP 2001-209335 8/2001
JP 2001-350425 12/2001
JP 2002-169484 6/2002
JP 2000-17091 1/2004

OTHER PUBLICATIONS

Murakami et al. Latest Advances in Surface Modification of Fluropolymers vol. 34 No. 1 dated May 1999.
Inoue et al. The Effects of Ar Ion-Implantation on Hydrophobic of Flourine-polymer; p. 15-20 dated 1999.
Inoue et al. Effects of Roughness and Chemical Composition of an Ar Ion-Implanted Flourine-Polymer on Water Repellency vol. 51 No. 5 dated 2000.

* cited by examiner

*Primary Examiner*—Manish S. Shah
(74) *Attorney, Agent, or Firm*—Whitham Curtis Christofferson & Cook, PC

(57) ABSTRACT

The image display apparatus includes an image display unit having an image display surface, an image forming unit for forming an image on the image display surface by ejecting ink droplets toward the image display surface and an image erasing unit for erasing the formed image. Ink holding regions for holding ink droplets impinged to the image display surface and an ink repelling region for holding no ink are formed on the image display surface, and the ink holding regions are regularly arranged so that each ink holding region is surrounded by the ink repelling region.

6 Claims, 4 Drawing Sheets

IMAGE DISPLAY APPARATUS

BACKGROUND OF THE INVENTION

1. Field of the Invention

The present invention relates to a rewritable image display apparatus that displays an image by forming the image using ink droplets.

2. Description of the Related Art

Nowadays, various rewritable image display apparatuses are proposed, for displaying a still image by forming the image through ejection of ink droplets toward an image display surface. Such image display apparatuses are applicable to bulletin boards that are installed at station premises and display various kinds of information concerning trains such as train arrival and departure information and train delay information; electronic whiteboards that are used, for instance, at the time of conferences and preliminary meetings; advertising boards, signboards, and the like.

The rewritable image display apparatuses have such an advantage that it is possible to perform rewriting with ease and to provide information smoothly as compared with provision of information using paper. In addition, amounts of electric power consumed by the image display apparatuses are smaller than those consumed by CRTs, liquid crystal displays, and the like.

Examples of the rewritable image display apparatuses are disclosed in JP 2002-169484 A, JP 2001-350425 A, JP 2001-209335 A, and JP 2001-109406 A.

In JP 2002-169484 A, for instance, an image display apparatus is proposed which includes an input unit for inputting image data, an image processing unit for processing the inputted image data, a recording head that forms an image, an image display surface on which the image formed by the recording head is displayed, and an image erasing unit for erasing the displayed image. With this construction, a labor time for exchanging advertisements printed on paper can be avoided, and it becomes possible for a passenger in a train to view every advertisement without moving in the train.

Also, in JP 2001-350425 A, an image display apparatus is proposed which includes: an image forming member having an image forming surface; an ink jet image forming means for forming an image based on image data using oily pigment-based ink dispersed in a low-volatile oily solvent; and an image erasing means for erasing the formed image. With this construction, miniaturization, a reduction in power consumption, and the like are achieved.

Further, in JP 2001-209335 A, an ink jet display apparatus is proposed which includes a mechanism for ejecting ink from nozzles of an ink jet recording head and sending a printing medium on which display information has been recorded, with the printing medium being an endless resin sheet.

Also, in JP 2001-109406 A, an image display apparatus is proposed which includes a means for applying a treating liquid containing a cationic substance onto a display medium, an image writing means having an ink ejection means for ejecting the ink, and a means for erasing an image displayed on the display medium. With this construction, an image blurring phenomenon can be prevented at boundaries between images in different colors that occurs due to blurring of ink and mixture of dots.

In the apparatuses of JP 2002-169484 A, JP 2001-350425 A and JP 2001-209335 A, however, adjacent ink droplets impinged on different positions of the image display surface for displaying an image, the image forming surface or the resin sheet may often contact each other, thus causing image blurring.

On the other hand, the apparatus of JP 2001-109406 A is an image display apparatus in which impinged ink is not mixed with each other. However, since a treating liquid containing a cationic substance is applied to the display medium prior to image formation and an image is then written using the ink ejection means, the treating liquid is always necessary as well as ink, which makes the apparatus construction complicated.

SUMMARY OF THE INVENTION

The present invention has been made in order to solve the problems described above, and an object thereof is to provide an image display apparatus which is simple in apparatus construction and is practical, and in which ink droplets ejected toward different positions do not contact each other on an image display surface, thus causing no image blurring.

In order to attain the object described above, the present invention provides an image display apparatus comprising: an image display unit having an image display surface; an image forming unit for forming an image on said image display surface by ejecting ink droplets toward said image display surface; and an image erasing unit for erasing the formed image, wherein ink holding regions for holding ink droplets impinged to the image display surface and an ink repelling region for holding no ink are formed on said image display surface, and said ink holding regions are regularly arranged so that each ink holding region is surrounded by said ink repelling region.

Preferably, each of said ink holding regions is a region subjected to ink receptive treatment and said ink repelling region is a region subjected to ink repellent treatment.

Preferably, at least one of said ink holding regions holds one ink droplet for image formation.

Preferably, at least one of said ink holding regions holds plural ink droplets for image formation.

Preferably, at least one of said ink holding regions holds a part of one ink droplet, whose remaining parts are held by adjacent ink holding regions, for image formation.

DETAILED DESCRIPTION OF THE PREFERRED EMBODIMENT

Figure 1A:
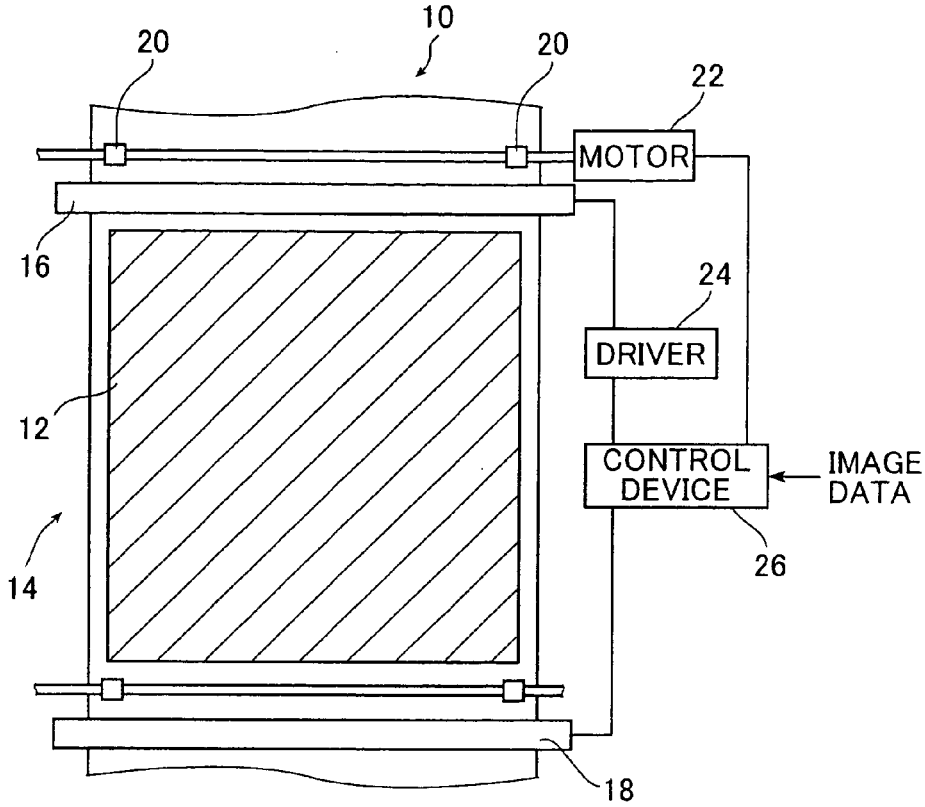
FIG. 1A is a schematic construction diagram of an image display apparatus that is an embodiment of an image display apparatus according to the present invention.
Figure 1B:
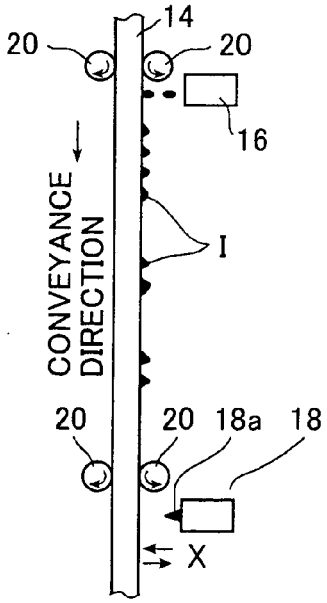
FIG. 1B is a schematic side view of the image display apparatus shown in FIG. 1A.

An image display apparatus according to the present invention will now be described in detail based on a preferred embodiment illustrated in the accompanying drawings FIG. 1A is a schematic construction diagram of an image display apparatus 10 that is an embodiment of the image display apparatus according to the present invention The image display apparatus 10 is a rewritable image display apparatus that is applied to an advertising board, a signboard, a bulletin board, or the like. FIG. 1B is a schematic side view of the image display apparatus 10.

The image display apparatus 10 mainly includes an image display unit 14 having an image display surface 12, an image forming unit 16 for forming an image on the image display surface 12 by ejecting ink droplets toward the image display surface 12, an image erasing unit 18 for erasing the formed image, conveyor rollers 20 that convey the image display unit 14, a drive motor 22 that drives the conveyor rollers 20, a driver 24 that generates a drive signal for the ejection of the ink droplets from the image forming unit 16, and a control device 26 that controls the operation of each of the driver 24, the drive motor 22, and the image erasing unit 18. Although not illustrated, in addition to these construction elements, the image display apparatus 10 includes a transparent casing that covers the image display unit 14, the image forming unit 16, and the image erasing unit 18.

The image display unit 14 has the image display surface 12 on its surface and serves as a member for forming an image by holding ink droplets ejected and impinged on the image display surface 12 at predetermined positions. In more detail, the image display unit 14 is an endless belt-like member whose beginning end and terminal end are connected to each other. The material of the image display unit 14 is not specifically limited, and it is possible to use various kinds of materials such as glass, a metal, or a resin. Preferably, a material is used so that an ink repellent region and ink receptive region are easily formed on the image display surface 12 through surface treatment, as will be described later.

Also, the image display unit 14 is a non-transparent member, and the image display surface 12 forms a reflection-type image display surface of a reflection-type display unit. In the present invention, however, the image display unit 14 may be made of a transparent member. In this case, the image display unit 14 is provided with a backlight on a back surface side of the image display unit 14, which is opposite to an image display surface side and a transmission-type image display unit is formed which displays an image by projecting light toward the image display surface from the back surface side using the backlight.

The image display unit 14 is an endless belt-like member whose beginning end and terminal end are connected to each other as described above, but this unit 14 may be constructed using a plate-like member.

The image forming unit 16 is an on-demand ink jet head that ejects ink droplets. In more detail, the image forming unit 16 is a site that is supplied with ink from a not-shown ink tank at all times and performs ink ejection with stability. As the image forming unit 16, a full-color line bead is formed by arranging ink ejection nozzles in a widthwise direction (right-left direction on the paper plane of FIG. 1A) that is perpendicular to the conveyance direction of the image display surface 12 (top-bottom direction on the paper plane of FIG. 1A) at constant intervals, for instance, 360 npi (nozzle/inch). Here, multiple nozzle rows that are longer than the width of the image display surface 12 are formed so as to correspond to respective ink colors.

The conveyor rollers 20 are constructed so as to rotate and move the image display unit 14 in the conveyance direction while the image forming unit 16 is ejecting ink droplets toward the image display surface 12. That is, the conveyor rollers 20 are rotationally driven by the drive motor 22 based on a control signal from the control device 26. As a result, an image is two-dimensionally formed with the ink droplets ejected from the image forming unit 16 by continuously or intermittently moving the image display unit 14 by driving the conveyor rollers 20 in the conveyance direction. After the image is formed by conveying the image display unit 14, the conveyance of the image display unit 14 is stopped, and the image display surface, on which the image has been formed, is exhibited for image displaying.

Also, the image forming unit 16 is provided with a not-shown moving mechanism that is minutely movable in the widthwise direction. With this construction, the ink ejection nozzles are positioned so as to oppose the predetermined positions on the image display surface 12.

Here, the image forming unit 16 may be an ink jet head adopting a thermal system in which air bubbles are generated by partially heating and boiling ink through heat generation by a heat generation heater and ink droplets are ejected from the ink ejection nozzles by means of expansive forces of the generated air bubbles. Alternatively, the image forming unit 16 may be an ink jet head adopting a piezoelectric system in which the ejection of ink droplets is achieved by mechanically applying pressures to ink by utilizing the deformation characteristics of a piezoelectric element. Still alternatively, the image forming unit 16 may be an ink jet head adopting a system in which electrostatic forces are utilized.

Also, the image forming unit 16 is a line head in which the length of the ink ejection nozzle rows is set longer than the width of the image display surface 12. In the present invention, however, the image forming unit 16 may be a serial head in which the length of the ink ejection nozzle rows is set shorter than the width of the image display surface 12. In this case, image formation is performed by moving the head in the widthwise direction.

As shown in FIG. 1B, the image erasing unit 18 includes a blade 18*a* that is slidable on the image display surface 12. Also, the image erasing unit 18 is provided with a mechanism for moving the blade 18*a* in an X direction shown in FIG. 1B in accordance with the control by the control device 26 so that the blade 18*a* is abutted against the image display surface 12. With this construction, during the conveyance of the image display unit 14 by the conveyor rollers 20, the blade 18*a* is set so as to relatively slide on the image display surface 12 of the image display unit 14 that is moved in accordance with the control by the control device 26. As a result, the ink droplets held on the image display surface 12 or an ink colorant layer formed by dried and solidified ink is scraped off by the blade 18*a* and erasing of an image is achieved. The ink droplets or ink colorant layer scraped off by the blade 18*a* are or is recovered by a not-shown recovering device. Note that, immediately before the image erasing is performed, the ink droplets may be dried through irradiation of infrared rays or heat generation by a heater, and a solidified ink colorant layer may be scraped off.

Figure 2:
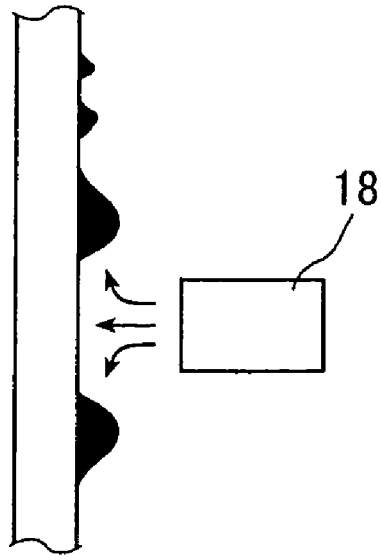
FIG. 2 illustrates an example of an image erasing unit used in the image display apparatus according to the present invention.

The image erasing unit 18 scrapes off the ink droplets or ink colorant layer on the image display surface 12 using the blade 18*a*, although the present invention is not limited to this. For instance, as shown In FIG. 2, the ink droplets held at the predetermined positions may be blown off by blowing air to the ink droplets and the blown-off ink droplets may be recovered by the not-shown recovering device.

In the image display apparatus 10 having the construction described above, multiple ink receptive regions and an ink repellent region are formed on the image display surface 12. Here, the ink receptive regions are regularly arranged so that each ink receptive region is surrounded by the ink repellent region. That is, the ink receptive regions serve as ink holding regions in which ink droplets impinged on the image display surface 12 are held. On the other hand, the ink repellent region serves as an ink repelling region in which ink droplets are not held.

When water-based ink is used, for instance, the image display unit 14 is formed using a member made of a fluorine-based resin material such as PTFE (polytetrafluoroethylene) and water receptive regions are regularly formed on the surface of this member as the ink receptive regions. Here, the method for forming the water receptive regions is not specifically limited. For instance, there may be used the water receptive treatment method described in "Leading-edge Surface Modification Technology for Fluororesin (Nitto Technical Report, Vol. 34, No. 1 (May 1996))". Alternatively, water repellent treatment may be performed on a water receptive member, thereby forming a water repellent region as the ink repellent region that surrounds each ink receptive region. Note that the water repellent treatment is not specifically limited. For instance, an Ni metallic thin film may be formed on the member surface of the image display unit 14, and a known composite plating method may be used by regarding the Ni metallic thin film as an electrode. Alternatively, the water repellent treatment may be performed using the fluororesin surface treatment method disclosed in JP 2000-17091 A or the ultra-water repellent treatment method described in "Influence of Ar Ion Implantation on Ultra-water Repellent Property of Fluororesin (preliminary report collection for 15-th Ion Implantation Surface Treatment Symposium)", etc.

On the other hand, when oil-based ink is used, the ink holding regions and the ink repelling region of the image display unit 14 are respectively regarded as water repellent regions and a water receptive region. In this case, water repellent treatment or water receptive treatment is performed in accordance with the surface characteristics of the image display unit 14 (whether the image display unit 14 has a water receptive surface or a water repellent surface).

As described above, the ink holding regions 12*a* are formed as ink receptive regions through water receptive treatment or water repellent treatment in accordance with whether water-based ink or oil-based ink is used. Alternatively, the ink repelling region 12*b* is formed as an ink repellent region through water repellent treatment or water receptive treatment in accordance with whether water-based ink or oil-based ink is used.

Figure 3:
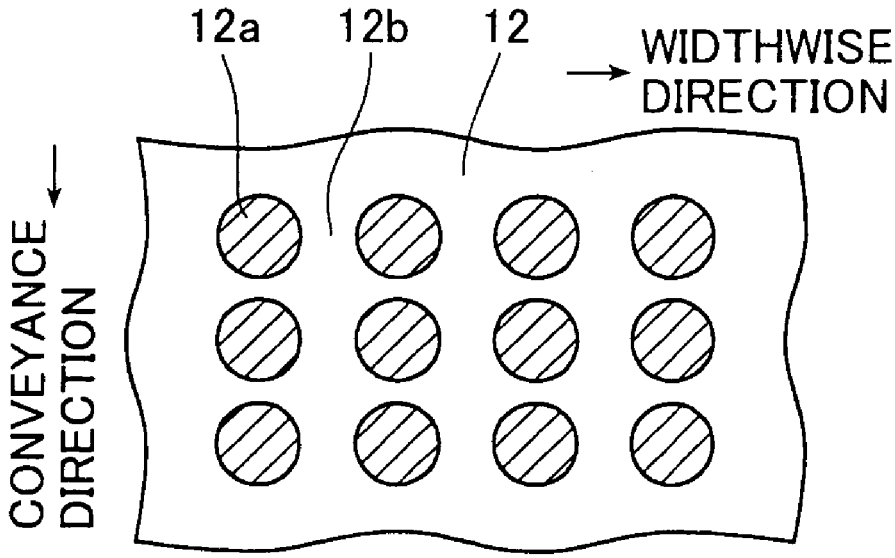
FIG. 3 illustrates an example of an arrangement of ink holding regions and an ink repelling region formed on an image display surface in the image display apparatus according to the present invention.

FIG. 3 shows multiple ink holding regions 12*a* and an ink repelling region 12*b* formed on the image display surface 12.

Each ink holding region 12*a* is a circular region having a constant diameter that is approximately equal to or somewhat larger than that of each ink droplet ejected from the image forming unit 16. Also, the ink holding regions 12*a* are arranged at arrangement intervals that are the same as the arrangement intervals of the ink ejection nozzles in the widthwise direction of the image display surface 12 of the image forming unit 16. For instance, if the ink ejection nozzles are arranged at 360 npi, the ink holding regions 12*a* are arranged at intervals of 70.6 μm (=25.4/360). In addition, the position of the image forming unit 16 relative to the image display unit 14 is maintained by a moving mechanism for minutely moving the image forming unit 16 in the widthwise direction so that each of the ink ejection nozzles of the image forming unit 16 is set so as to oppose one of the ink holding regions 12*a*. With this construction, the relative positional relationship between the image display unit 14 and the image forming unit 16 is maintained at all times. As a result, it becomes possible to cause ink droplets ejected from the image forming unit 16 to impinge on different ink holding regions. In addition, the ink holding regions are each formed as an ink receptive region, so that the impinged ink droplets are held by the ink holding regions existing at their impingement position. Therefore, there is prevented a situation where ink droplets in adjacent ink holding regions contact each other and are mixed with each other. As a result, it becomes possible to prevent blurring of an image.

As described above, on the image display surface 12, the ink holding regions 12*a* are formed at the impingement positions of ink droplets on the image display surface 12.

Figure 4:
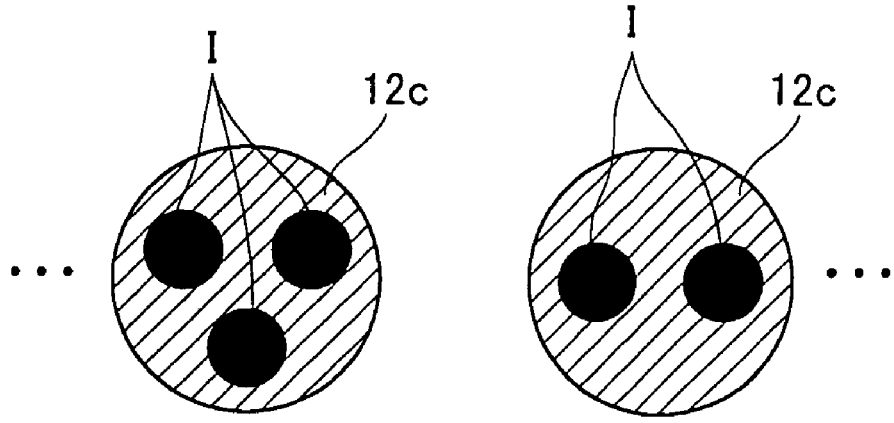
FIG. 4 illustrates an example of a relationship between the ink holding regions on the image display surface and ink droplets impinged on the ink holding regions in the image display apparatus according to the present invention.

FIG. 4 shows another form of the relationship between the ink holding regions formed on the image display surface 12 and the ink droplets impinged on the ink holding regions.

In FIG. 4, ink holding regions 12*c* each have a circular shape whose diameter is far larger than that or the ink droplets I. This construction allows each ink holding region 12*c* to hold multiple ink droplets. Accordingly, the image forming unit 16 becomes capable of causing multiple ink droplets to impinge on the same ink holding region 12*c*. In FIG. 4, one of the ink holding regions 12*c* that are adjacent to each other holds three ink droplets, and the other of the ink holding regions 12*c* holds two ink droplets. By changing the number of ink droplets held in one ink holding region 12*c*, it becomes possible to express different image densities in the ink holding region 12*c*. In a like manner, by causing ink droplets in different colors to impinge on the same ink holding region 12*c*, it becomes possible to express different hues in one ink holding region. In addition, ink droplets impinged on adjacent ink holding regions are prevented from contacting each other, so that it becomes possible to prevent blurring of an image.

Figure 5:
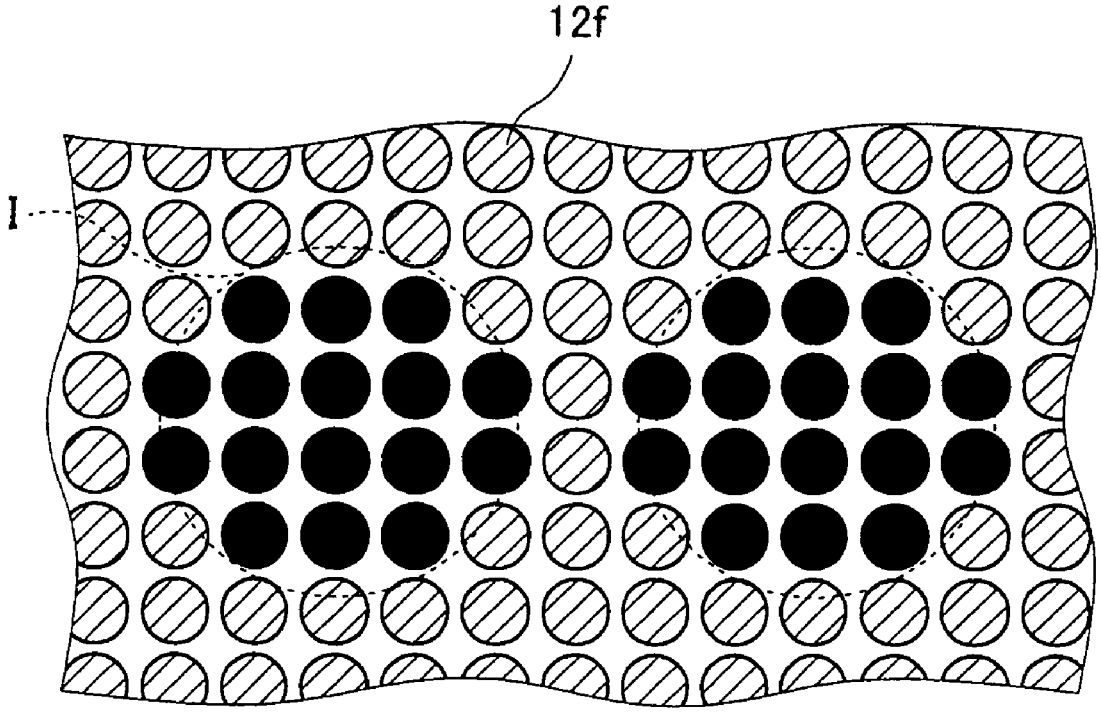
FIG. 5 illustrates another example of the relationship between the ink holding regions on the image display surface and the ink droplets impinged on the ink holding regions in the image display apparatus according to the present invention.

FIG. 5 shows still another form of the relationship between the ink holding regions formed on the image display surface 12 and the ink droplets impinged on the ink holding regions.

In FIG. 5, ink holding regions 12*f* are regularly arranged so that each ink holding region is surrounded by an ink repelling region. Also, the ink holding regions 12*f* each have a circular shape whose diameter is set far smaller than that of the ink droplet I. With this construction, a single ink droplet I is held by multiple ink holding regions 12*f*. Consequently, after impinging on the image display surface 12, the ink droplet I is divided and is contained in multiple adjacent ink holding regions 12*f* existing at its impingement position due to a difference in surface tension between the ink holding regions and the ink repelling region. As a result, each ink holding region 12*f* holds a part of the ink droplet I. Even in this case, the ink holding regions 12*f* are arranged so as to be surrounded by the ink repelling region independently of each other. Therefore, the parts of the ink droplet are prevented from contacting each other after the impingement. As a result, it becomes possible to prevent blurring of an image.

As described above, in the image display apparatus according to the present invention, at least one of the ink holding regions holds one ink droplet for image formation Alternatively, at least one of the ink holding regions holds multiple ink droplets for image formation. Still alternatively, at least one of the ink holding regions holds a part of one ink droplet, whose remaining parts are held by its adjacent ink holding regions, for image formation.

Figure 6:
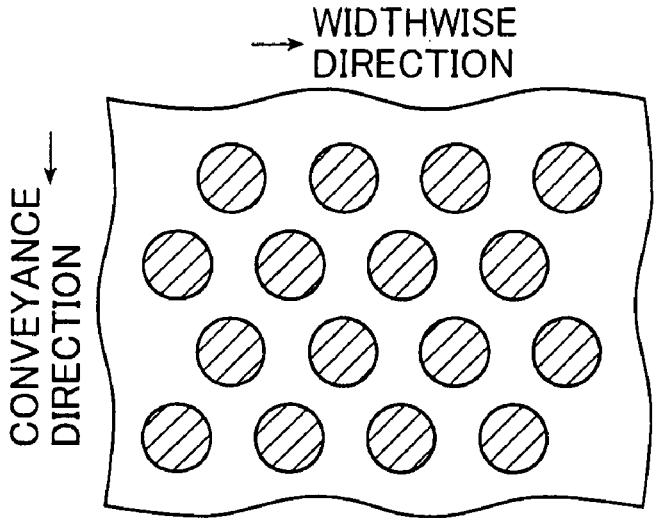
FIG. 6 illustrates another example of the arrangement of the ink holding regions and the ink repelling region formed on the image display surface in the image display apparatus according to the present invention.

It should be noted here that in FIG. 3, the ink holding regions 12*a* are regularly patterned in a lattice manner at constant intervals in the widthwise direction and the conveyance direction of the image display surface 12. However, the present invention is not limited to this, and may be changed so long as the ink holding regions 12*a* are regularly arranged. For instance, as shown in FIG. 6, the ink holding region rows in the widthwise direction may be arranged in a staggered configuration in the conveyance direction. In this case, the image forming unit 16 using the line head is constructed so as to be minutely moved in the widthwise direction in accordance with the arrangement of the ink holding regions 12*a*.

Also, in the above description, the ink holding regions have a circular shape, but the present invention is not limited to this, and the ink holding regions may have a triangular shape, a rectangular shape, a pentagonal shape, or the like.

In the image display apparatus 10 having the construction described above, image data is supplied to the control device 26. Then, the control device 26 generates a control signal, and the driver 24 generates a drive signal. Following this, the drive signal is supplied to the image forming unit 16, and ejection of ink droplets is started. The drive motor 22 rotationally drives the conveyor rollers 20 so that the image display unit 14 is conveyed in accordance with the ink droplet ejection.

Also, the image display apparatus 10 continuously detects not-shown registration marks provided on the image display surface 12, minutely adjusts the position of the image forming unit 16 in the widthwise direction using a not-shown moving mechanism in accordance with the positions of the marks, and positions the ink ejection nozzles so as to precisely oppose the positions of the ink holding regions 12*a* on the image display surface 12. Then, ink droplets are ejected from the ink ejection nozzles, and the ink holding regions 12*a* hold the ejected ink droplets.

When water-based ink is used, the ink holding regions 12*a* for holding ejected ink droplets are each formed as a water receptive region that is surrounded by the ink repelling region 12*b* that is formed as a water repellent region. Therefore, the ink droplets are held in the ink holding regions 12*a* and are prevented from contacting other ink droplets held in adjacent ink holding regions. As a result, there is prevented blurring of a formed image.

If the ink ejection nozzles of the image forming unit 16 and the ink holding regions 12*a* are not positioned so as to precisely oppose each other and are displaced to some extent, ink droplets impinge on both of the ink hold regions 12*a* and the ink repelling region 12*b*. Even in this case, the ink droplets move so as to be contained within the ink holding regions 12*a* due to a difference in surface tension between the ink holding regions 12*a* and the ink repelling region 12*b*.

Meanwhile, when erasing an image, the conveyor rollers 20 are rotated, and the image display unit 14 is moved in the conveyance direction. Then, the ink droplets or the ink colorant layer are or is scraped off by the blade 18*a* of the image erasing unit 1*e* sliding on the image display unit 14. As a result, the image is erased, and a new image display surface 12 is obtained on which a new image is to be formed.

It should be noted here that if the image display apparatus 10 frequently performs image rewriting, the water receptive property or the water repellent property of the ink holding portions 12*a* or the ink repelling portion 12*b* is degraded. In view of this problem, the image display apparatus 10 may be provided with a treatment device that recovers the degraded water receptive property or water repellent property. For instance, a liquid droplet ejecting device may be provided which ejects a water repellent agent or a water receptive agent to the degraded ink holding regions or ink repelling region as liquid droplets.

Figure 7A:
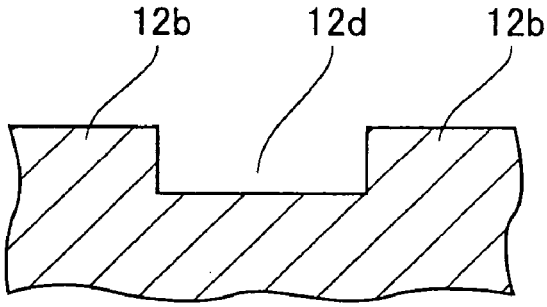
FIG. 7A illustrates another form of the ink holding regions in the image display apparatus according to the present invention.

In the embodiment described above, the ink holding regions are each formed as the ink receptive regions, or the ink repelling region is formed as the ink repellent region through surface treatment. However, the present invention is not limited to this For instance, as shown in FIG. 7A, the ink holding regions may be formed as recess portions 12*d* that are recessed from the ink repelling region, and ink droplets may be held in the recess portions 12*d*. In this case, in order to make it possible to hold ink droplets with reliability, it is preferable that the bottom surfaces and side surfaces of the recess portions 12*d* are converted into ink receptive surfaces through surface treatment, and the ink repelling region surrounding the recess portions 12*d* is converted into an ink repellent region through surface treatment.

Figure 7B:
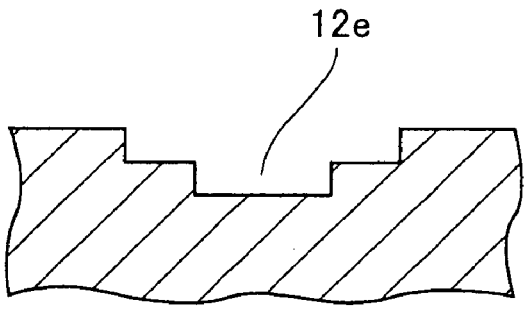
FIG. 7B illustrates sill another form of the ink holding regions in the image display apparatus according to the present invention.

Also, as shown in FIG. 7B, the ink holding portions may be recess portions 12*e* that are recessed in two steps. For example, the recess portions 12*e* are capable of holding multiple ink droplets, thereby widening the area of the image display surface. As a result, it becomes possible to express different image densities through area modulation.

The image display apparatus according to the present invention has been described in detail above, but the present invention is not limited to the embodiment described above, and it is of course possible to make various modifications and changes without departing from the gist of the present invention.

As described in detail above, on the image display surface of the image display apparatus according to the present invention, multiple ink holding regions for holding ink droplets ejected toward the image display surface and an ink repelling region are formed, and the ink holding regions are regularly arranged so that each ink holding region is surrounded by the ink repelling region. As a result, there is prevented a situation where ink droplets ejected toward different positions contact each other on the image display surface and there occurs image blurring. Also, it becomes unnecessary to apply a treating liquid immediately before image formation, so that the image display apparatus according to the present invention is achieved with a simple apparatus construction and is superior in practicality.

What is claimed is:

1. An image display apparatus comprising:

an image display unit having an image display surface;

an image forming unit for forming an image on said image display surface by ejecting ink droplets toward said image display surface; and an image erasing unit for erasing the formed image, wherein said image display surface includes at least one ink repelling region, said region formed of a material having a surface repellant to said ink, and a plurality of ink holding regions, to hold said ejected ink droplets, arranged according to a matrix-like pattern so that each of the ink holding regions is surrounded by said ink repelling region.

2. The image display apparatus according to claim 1, wherein each of said ink holding regions is formed by a material having a surface attractive to said ink.

3. The image display apparatus according to claim 1, wherein at least one of said ink holding regions is dimensioned and arranged to hold one of said ink droplets droplet for image formation.

4. The image display apparatus according to claim 1, wherein at least one of said ink holding regions is dimensioned and arranged to hold a plurality of said ink droplets for image formation.

5. The image display apparatus according to claim 1, wherein a plurality of adjacent ones of said ink holding regions are dimensioned and arranged to collectively hold one of said ink droplets.

6. The image display apparatus according to claim 1, wherein said image display surface includes a plurality of ink repelling regions, each of said plurality of ink repelling regions formed of a material having surface repellant to said ink, and a plurality of ink holding regions, to hold said ejected ink droplets, arranged according to matrix-like pattern so that each of the ink holding regions is surrounded by corresponding ones of said ink repelling regions.

* * * * *